US011007417B2

(12) United States Patent
Vigneau

(10) Patent No.: US 11,007,417 B2
(45) Date of Patent: May 18, 2021

(54) MULTISPORT SPACE FOR THE PRACTICE OF GOAL SPORTS AND NET SPORTS

(71) Applicant: Francois Emmanuel Vigneau, Banyuls-sur-Mer (FR)

(72) Inventor: Francois Emmanuel Vigneau, Banyuls-sur-Mer (FR)

( * ) Notice: Subject to any disclaimer, the term of this patent is extended or adjusted under 35 U.S.C. 154(b) by 0 days.

(21) Appl. No.: 16/631,596

(22) PCT Filed: Jul. 11, 2018

(86) PCT No.: PCT/EP2018/068834
§ 371 (c)(1),
(2) Date: Jan. 16, 2020

(87) PCT Pub. No.: WO2019/016049
PCT Pub. Date: Jan. 24, 2019

(65) Prior Publication Data

US 2020/0179786 A1 Jun. 11, 2020

(30) Foreign Application Priority Data

Jul. 17, 2017 (FR) ..... 1756777

(51) Int. Cl.
*A63B 71/02* (2006.01)
*A63B 61/00* (2006.01)
*A63C 19/08* (2006.01)

(52) U.S. Cl.
CPC ..... *A63B 71/022* (2013.01); *A63B 61/003* (2013.01); *A63C 19/08* (2013.01); *A63B 2209/00* (2013.01); *A63C 2019/085* (2013.01)

(58) Field of Classification Search
CPC ... A63C 19/08; A63C 19/06; A63C 2019/085; A63C 19/02; A63B 71/022; A63B 71/02; A63B 61/003; A63B 61/00; A63B 2209/00
See application file for complete search history.

(56) References Cited

U.S. PATENT DOCUMENTS 3,452,985 A 7/1969 Zmura
4,108,434 A 8/1978 Royer
4,569,515 A 2/1986 Gordon
9,155,957 B1 * 10/2015 Moody ..... A63C 19/08
(Continued)

FOREIGN PATENT DOCUMENTS

EP 2388051 A1 11/2011
EP 2591830 A1 5/2013
(Continued)

*Primary Examiner* — Raleigh W Chiu
(74) *Attorney, Agent, or Firm* — Craft Chu PLLC; Andrew W. Chu

(57) ABSTRACT

The multisport space includes a plurality of different fields for goal sports and net sports. There is a first square or rectangular area for goal sports delimited by a vertical wall. The first goal sports area has a goal sports field in which the goals are vertical and extend from ground level. There is a goal sports field in which the goals are horizontal and placed at a certain height. The panels of the vertical wall form nets for a plurality of net sports fields arranged on either side of the panels of the vertical wall. Extensions of panels, leading from their respective implantation axes, also form nets for net sports fields.

10 Claims, 4 Drawing Sheets

(56) References Cited

U.S. PATENT DOCUMENTS

| | | | | |
|---|---|---|---|---|
| 2007/0213146 | A1* | 9/2007 | Lagergren | A63C 19/08 473/415 |
| 2011/0028249 | A1* | 2/2011 | Ofori-Ansah | A63C 19/00 473/471 |
| 2013/0005515 | A1* | 1/2013 | Saphire | A63B 67/002 473/492 |
| 2013/0316857 | A1* | 11/2013 | Walton | A63C 19/02 473/478 |
| 2015/0057114 | A1* | 2/2015 | Ehasoo | A63B 61/02 473/492 |
| 2020/0179786 | A1* | 6/2020 | Vigneau | A63B 61/003 |
| 2020/0246679 | A1* | 8/2020 | Oliveira | E04B 1/3445 |

FOREIGN PATENT DOCUMENTS

| | | | |
|---|---|---|---|
| GB | 2448989 | A | 11/2008 |
| WO | 2012 031319 | A1 | 3/2012 |

* cited by examiner

MULTISPORT SPACE FOR THE PRACTICE OF GOAL SPORTS AND NET SPORTS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the field of sports and the fitting-out of complexes for the practice of a plurality of sports.

The present invention relates to a multisport complex for goal sports and net sports, consisting of pitches for the practice, in particular for leisure purposes, of a plurality of individual (one against one) or collective (one team against another) opposition sports played with a ball, a shuttlecock, a quoit, or any other sports game projectile.

2. Description of Related Art Including Information Disclosed Under 37 CFR 1.97 and 37 CFR 1.98

Multisport terrains for leisure purposes, in particular those realized industrially, are associated with a plurality of functionality and even security issues.

Practice of badminton, tennis or volleyball on a pitch that is also intended for the practice of football, handball or basketball is possible only with difficulty because installing, taking down and putting away nets, or even posts, poses problems of handling and storage. Handling of posts, which are often heavy, poses safety risks for those handling them. Furthermore, said material, in particular the nets, is exposed to risks of vandalism.

Setting up a pitch for small-sided football, or a handball pitch, and a basketball pitch, poses problems of safety or functionality. Indeed, in this configuration, the necessary setting up of basketball goals (panels and circles) above goals (cages) for small-sided football or for handball results in a reduced offset of the basketball goal relative to the vertical of the small-sided football and the handball goal, which brings about a risk of collision, for basketball players, with the posts or the horizontal bar of the goal, or with the wall which is intended for returning the balls and into which the goal is often cut, specifically by means of a larger offset in order to ensure the safety of the basketball players, but which then represents an obstacle for the balls in the football or handball playing space.

Setting up a plurality of rectangular pitches in two different, generally perpendicular, axes, also poses safety problems. Indeed, when the goals are set up in isolation, as in the case of competition or physical education and traditional sports pitches, the goals arranged at the two ends of the longitudinal axis of one of the two pitches represents a collision risk for the players playing in the longitudinal axis of the other pitch. When the goals are integrated into a wall which is used in particular for returning the balls into the playing area, in the manner of a rail surrounding an ice hockey pitch, the walls surrounding the pitches arranged in different axes (generally in a cross-shape) form acute angles therebetween, which also pose risks for the safety of the players.

Furthermore, the realization of rectangular pitches generally does not correspond to the hopes of players devoted to a leisure sports activity. Indeed, the rectangular shape causes relative distancing of the opposing goal which requires energy expenditure in order to convey the ball from one goal to the other (the usual expression "bring the ball up" is explicit), and/or requires placement of field players according to relatively specialized posts (defense, passer, attack) whereas, for leisure practice in particular, the players wish to be able to participate as much as possible in the game, i.e. to have as much contact as possible with the ball and to devote the majority of their energy thereto.

Some patents propose original pitch types for new net sports, but which do not allow for multisport practice and are not functional for traditional net sports. Thus, the patent applications U.S. Pat. No. 3,452,985 A (J D ZMURA Cornelius) and U.S. Pat. No. 4,108,434 A (ROYER George Ronald) propose a game that is played on a table, and a table-tennis table, respectively, both comprising a plurality of nets so as to allow for three or four players or teams to play together. Since each has a quasi-triangular or circular arc shaped playing area, the practice of traditional net sports, one against one or one team against another, is not 30 possible. The game tables proposed by these patents allow only for the practice of said new game, and said new form of table tennis, respectively. The patent application U.S. Pat. No. 4,569,515 A (GORDON Donald W) proposes a structure in which it is possible to practice, simultaneously and independently, a form of volleyball consisting in passing the ball not over the net, but rather in a slot between two nets. Nonetheless, said structure is intended only for four players playing together, two against two, or separately, in two matches of one against one, and not in larger teams. Moreover, this structure comprises a playing surface that bounces in the manner of a trampoline or by means of air cushions. In any case, since the upper portion of the nets is at the same height, said structure does not allow the practice of a plurality of net sports according to traditional rules.

With respect to the patent application GB 2 448 989 A (J. B. Corrie and Company Ltd), said document proposes a device for dividing a sports pitch into a plurality of small pitches, for sports or other use, by means of taut nets. However, said nets are intended for isolating different pitches, and not for being used as sports nets separating the two sides of one pitch. In any case, being at the same height, said nets cannot allow for multisport practice.

The patent EP 2 591 830 B (VIGNEAU François-Emmanuel) discloses a multisport complex consisting of a plurality of different pitches for net sports such as badminton, Sepak takraw, volleyball, tennis, foot-tennis, or even paddle tennis, set up according to two perpendicular axes, and nets arranged on two perpendicular axes, in which said nets that divide each pitch into two parts are fixed and the upper edges of said nets are at different heights, suitable for the practice of said different sports, so as to allow for the practice of a plurality of sports simultaneously or the practice of one sport on a plurality of pitches and, in success, the practice of one or more other sports. A multisport complex of this kind does not provide for the practice of goal sports.

The patent EP 2 388 051 B (VIGNEAU François-Emmanuel proposes a multisport complex consisting of a pitch surrounded by a vertical wall comprising a playing area for standing sports for which the goals are vertical and start from ground level, such as small-sided football, handball, and any form of hockey, and a playing area for standing sports for which the goals are horizontal and positioned at a height, such as basketball, in which the sections of the vertical wall surrounding the goal sports pitch form the nets over which the balls or shuttlecocks of a plurality of net sports pitches, such as badminton, Sepak takraw, tennis, foot-tennis and volleyball, have to pass, said net sports pitches being arranged on either side of the sections of said vertical wall. In order to free the central pitch in order to accommodate playing areas for goal sports, the walls acting as nets are arranged around said central pitch, in a square. Furthermore, the net sports pitches, arranged on either side of said walls, are aligned, two by two, in accordance with the longitudinal axis thereof. Thus, the multisport complex has a limited capacity for simultaneous use of pitches: either one goal sports pitch or at most four net sports pitches.

BRIEF SUMMARY OF THE INVENTION

In order to overcome these various drawbacks of the prior art, according to a first aspect the present invention relates to a multisport complex comprising a plurality of different pitches that can be used simultaneously for goal sports and net sports:

comprising a first square or rectangular goal sports area delimited by a vertical wall, said first goal sports area comprising a pitch for the goal sports for which the goals are vertical and start from ground level, and a pitch for goal sports for which the goals are horizontal and positioned at a height;

in which the sections of the vertical wall surrounding the first goal sports area form nets of a plurality of net sports pitches over which net sports projectiles have to pass, said net sports pitches being arranged on either side of the sections of said vertical wall;

in which, in the region of at least one angle of the first goal sports area, the two sections set up according to two perpendicular axes in order to form said angle each comprise a section extension, in the extension of the respective set-up axis thereof, said extensions proceeding from said angle towards the outside of the first goal sports area;

and in which each section extension forms a net of at least one net sports pitch, over which net sports projectiles must pass, the at least two net sports pitches thus formed extending along perpendicular axes.

The present invention is advantageous in that it allows for the practice of a plurality of goal sports and net sports simultaneously on the multisport complex. According to the embodiment, for four different sports (goal sports having horizontal goals, goal sports having vertical goals, net sport X and net sport Y) it is thus possible, without modifying the multisport complex, in particular without manipulating the nets formed by the wall sections and formed by the section extensions, to use up to six pitches simultaneously for practicing four different sports simultaneously, depending on the selected sports, and up to seven pitches simultaneously for practicing two or three different sports simultaneously, depending on the selected sports, and up to eight pitches simultaneously for practicing one of the different sports, depending on the selected sport. The number of different sports that can be practiced simultaneously is not limited to four. Indeed, depending on the horizontal dimensions of the first playing area selected, the dimensions of the net sports pitches selected, and the heights selected (which may be different) for the nets formed by each wall section and formed by each section extension for each of the net sports pitches, it is possible to practice more than four different sports simultaneously.

According to preferred embodiments, the invention furthermore complies with the following features, implemented separately or in each of the technically effective combinations thereof.

The vertical wall sections and the section extensions thus function as games nets for the net sports pitches. The vertical wall sections and/or the section extensions can be solid and/or apertured. The vertical wall sections and the section extensions can furthermore be rigid and/or flexible. For example, the vertical wall sections and/or the section extensions can have a rigid bottom portion topped by a flexible portion.

In a particular embodiment, each wall section and each extension is formed by one of the following elements or a mixture of at least two of said 30 elements:

a vertical, apertured or solid but see-through, wall or membrane a lattice made up of natural or synthetic, armored or non-armored fibers, having wires made of metal or any other material, a lattice made up of cables, rods or profiles made of metal or any other material, that may or may not be protected by cladding made of a synthetic material.

A wall section or a section extension can, for example, be formed of a wall having a rigid bottom portion topped by a lattice of synthetic fibers.

The different wall sections and the different extensions can be formed differently.

The first area for goal sports, such as small-sided football, handball, basketball, all forms of hockey played on foot or on traditional roller skates or roller blades, is thus surrounded, in the region of the ground, by a vertical wall that can be solid and/or apertured and which is used for returning the ball into the playing area. The vertical goals, for small-sided football, handball, or even the different forms of hockey, are arranged in said vertical wall so as to comprise the fewest possible projecting parts that could represent a risk for the safety of the players.

Depending on the capacity of the first goal sports area and depending on the possible safety regulations, at least one passage must be arranged in the vertical wall for entry into the first goal sports area.

According to a particular embodiment, the pitch for sports for which the goals are vertical and start from ground level, such as small-sided football, handball, and all forms of hockey, and the pitch for sports for which the goals are horizontal and at a height, such as basketball, are not in the same axis but are perpendicular. The two pitches share a portion of the surface thereof.

In a particular embodiment:

in the region of at least two consecutive angles of the first goal sports area, the two wall sections set up according to two perpendicular axes in order to form each angle, each comprise a section extension, in the extension of the respective set-up axis thereof, proceeding from said angle towards the outside of the first goal sports area;

for each of the two consecutive angles, each section extension forms a net of at least one net sports pitch, over which net sports projectiles must pass, the at least two net sports pitches thus formed extending along perpendicular axes;

the section extensions of the two consecutive angles which are mutually parallel furthermore form two opposing limits of an additional square or rectangular goal sports area comprising a pitch for goal sports for which the goals are vertical and start from ground level, and a pitch for goal sports for which the goals are horizontal and positioned at a height.

In a particular embodiment:

in the region of each angle of the first goal sports area, the two wall sections set up according to two perpendicular axes in order to form said angle each comprise a section extension, in the extension of the respective set-up axis thereof, proceeding from said angle towards the outside of the first goal sports area;

for each angle, each section extension forms a net of at least one net sports pitch, over which net sports projectiles must pass, the at least two net sports pitches thus formed extending along perpendicular axes;

for the section extensions, each pair of consecutive angles which are mutually parallel furthermore forms two opposing limits of an additional square or rectangular goal sports area comprising a pitch for goal sports for which the goals are vertical and start from ground level, and a pitch for goal sports for which the goals are horizontal and positioned at a height.

The upper edges of the nets formed by the wall sections surrounding the first goal sports area, and the upper edges of the nets formed by the section extensions, are at a height relative to ground level that corresponds to the heights of the nets in the different net sports. For example, the upper edges of the nets formed by the wall sections in which the vertical goals are arranged can be at the height of a men's (2.43 m) and/or women's (2.24 m) volleyball net. The upper edges of the nets formed by the wall sections in front of which the basketball panels and circles are located, which can be at the height of a badminton and Sepak takraw net (1.524 m) and/or tennis net (0.914 m). In order to facilitate the practice of said sports by children, adults, older or disabled people, said heights can be reduced.

In a particular embodiment, none of the nets formed by the vertical wall sections and formed by the section extensions has an upper edge at the same height, relative to the ground, as any of the other nets formed by the vertical wall sections and by the section extensions.

According to a particular embodiment, for each wall section, the net or nets formed by the wall section, and the nets formed by the extensions of said wall section, have upper edges at the same height relative to the ground, in order to allow for a plurality of identical net sports pitches to be set up in parallel, in the same axis, and thus for the same sport to be practiced simultaneously on said identical net sports pitches.

In a particular embodiment, the upper edges of the net or nets formed by a first wall section of the first goal sports area are at a height, relative to the ground, that is different from the height, relative to the ground, of the upper edges of the net or nets formed by a second wall section that is perpendicular to the first section, said different heights being suitable for the practice of different net sports.

In a particular embodiment, for each angle of the first goal sports area from which the section extensions start, the net formed by a section extension starting at said angle has an upper edge that is at a height, relative to the ground, that is different from the height, relative to the ground, of the upper edge of the net formed by the other section extension starting at the same angle, said different heights being suitable for the practice of different net sports.

In a particular embodiment, the wall section extensions are of different lengths.

In a particular embodiment, the ground of the different sports pitches is formed of loose materials, such as sand, for the practice of "beach sports" such as "beach volleyball" or beach badminton.

BRIEF DESCRIPTION OF THE SEVERAL VIEWS OF THE DRAWINGS

The invention will be better understood upon reading the following description, given by way of non-limiting and provided with reference to the figures.

DETAILED DESCRIPTION OF THE INVENTION

It will immediately be noted that the figures are not to scale.

In a more general manner, the scope of the present invention is not limited to the embodiments described above by way of non-limiting example, but instead covers all modifications within the abilities of a person skilled in the art. Each feature of one embodiment can be implemented alone or in combination with any other feature of any other embodiment, in an advantageous manner.

Figure 1:
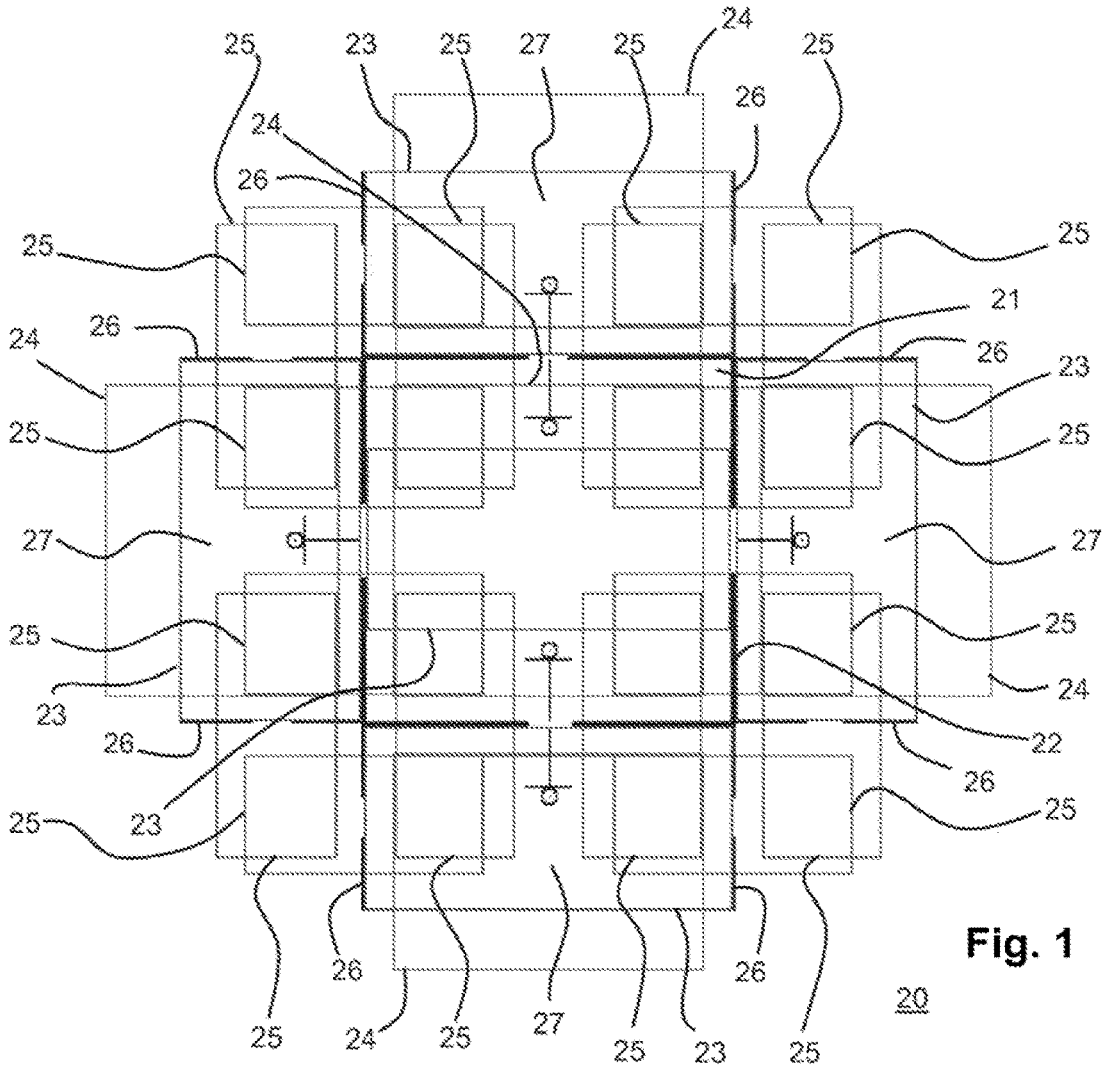
FIG. 1: is a plan view of the overall multisport complex comprising a first square goal sports area comprising goal sports pitches enclosed by a vertical wall, the different sections of which have extensions starting from angles of the first area, in the extension of the set-up axes of the sections, as well as net sports pitches set up on either side of the various sections of said wall, and on either side of the various extensions of the sections of the wall, but also of other goal sports areas in addition to the first, set up between the section extensions of each pair of consecutive angles that are mutually parallel.

FIG. 1 shows a multisport complex 20 according to a particular embodiment of the present invention. Said multisport complex 20 consists of a plurality of different pitches for goal sports and net sports. Said complex comprises a first square goal sports area 21 delimited by a vertical wall 22 (a first vertical wall 22A, a second vertical wall 22B connected to the first vertical wall, a third vertical wall 22C connected to the second vertical wall, and a fourth vertical wall 22D connected to the third vertical wall and the first vertical wall), said first goal sports area 21 comprising a pitch 23 for goal sports for which the goals are vertical and start from ground level, and a pitch 24 for goal sports for which the goals are horizontal and positioned at a height. In some embodiments, there is a first square 21 for at least one of a group consisting of a first vertical pitch 23A for goal sports for which goals are vertical and start from a ground level, and a first horizontal pitch 24A for goal sports for which goals are horizontal and positioned at a height.

The sections of the vertical wall 22 surrounding the first goal sports area 21 form nets of a plurality of net sports pitches 25 over which net sports projectiles have to pass, said net sports pitches 25 being arranged on either side of the sections of the vertical wall 22. In FIG. 1 it can be seen that each vertical wall 22 section forms net of two net sports pitches 25. Depending on the horizontal dimensions of the first goal sports area 21 selected and the dimensions of the net sports pitches 25 selected, each vertical wall 22 section can form nets of more than two net sports pitches 25. The second vertical wall 22B can be comprised of a second vertical wall section 22B' having a second vertical wall section height so as to form a first pitch for net sports 25A for which net sports projectiles pass over the second vertical wall section 22B'.

In the region of the four angles of the first goal sports area 21, the two sections set up according to two perpendicular axes in order to form each angle each comprise a section extension 26, in the extension of the respective set-up axis thereof, said extensions 26 proceeding from said angle towards the outside of the first goal sports area 21. There can be a first vertical wall right side section extension 26A1 connected to the first vertical wall and positioned outside the first square area 21, and a second vertical wall upper section extension 26B1 connected to the second vertical wall and positioned outside the first square area 21.

Each section extension 26 forms a net of at least one net sports pitch 25, over which net sports projectiles must pass, the two net sports pitches 25 thus formed extending along perpendicular axes. Each extension 26 can form a net of more than one net sports pitch 25, for example a net of two or three net sports pitches 25, or more. The first vertical wall 22A and the second vertical wall upper section 26B1 are perpendicular so as to form perpendicular axes of an angle between the first vertical wall 22A and the second vertical wall upper section 2661. The second vertical wall upper section 26B1 has a second vertical wall upper section height so as to form a second pitch for net sports 25B along the perpendicular axes of the angle between the first vertical wall 22A and the second vertical wall upper section 2661.

Furthermore, the nets formed by each vertical wall 22 section or formed by each section extension 26 can each have the upper edge thereof at different heights, with respect to one another, relative to the ground. Thus, depending on the horizontal dimensions of the first playing area 21 selected, the dimensions of the net sports pitches 25 selected, and the heights selected (which may be different) for the nets formed by each vertical wall 22 section and formed by each section extension 26 for each of the net sports pitches 25, it is possible to practice a plurality of different net sports simultaneously, or not, on the multisport complex 20. For example, two, three, four or even five different net sports can be practiced simultaneously, or not, on the multisport complex 20.

For each pair of consecutive angles formed by the sections of the vertical wall 22, the section extensions 26 of the two consecutive angles which are mutually parallel form two opposing limits of an additional square or rectangular goal sports area 27 comprising a pitch 23 for goal sports for which the goals are vertical and start from ground level, and a pitch 24 for goal sports for which the goals are horizontal and positioned at a height. There can be a third vertical wall right side section extension 26C1 connected to the third vertical wall and positioned outside the first square area 21. The third vertical wall right side section 26C1 has a third vertical wall right side section height so as to form a third pitch for net sports 25C1 along perpendicular axes of an angle between the second vertical wall 22B and the third vertical wall right side section 26C1. The first vertical wall right side section extension 26A1 and the third vertical wall right side section 26C1 are parallel. The first vertical wall right side section extension 26A1, the second vertical wall 22B, and the third vertical wall right side section 26C1 form a first additional square 27A for a second horizontal pitch 24B for goal sports for which goals are horizontal and positioned at a height. The first vertical wall right side section 26A1 has a first vertical wall right side section height so as to form an additional third pitch for net sports 25C2 along perpendicular axes of an angle between the second vertical wall 22B and the first vertical wall right side section 26A1.

According to an embodiment, for each wall section, the net or nets formed by the wall section, and the nets formed by the extensions of said wall section, have upper edges at the same height relative to the ground, in order to allow for a plurality of identical net sports pitches 25 to be set up in parallel, in the same axis, and thus for the same sport to be practiced simultaneously on said identical net sports pitches 25. The upper edges of the nets formed by a first wall section of the first goal sports area 21 and of the nets formed by the extensions 26 of said first section are at a height, relative to the ground, that is different from the height, relative to the ground, of the upper edges of the nets formed by a second wall section that is perpendicular to the first section, and the nets formed by the extensions 26 of said second section, said different heights being suitable for the practice of different net sports. Indeed, for each pair of parallel sections and the extensions 26 thereof (which are likewise parallel), the upper edges of the nets formed by said parallel sections, and of the nets formed by the extensions thereof, are at the same height relative to the ground. The first vertical wall right side section height of the first vertical wall right side section 26A1 is equal to the third vertical wall right side section height of the third vertical wall right side section 26C1 so as to form the additional third pitch for net sports 25C2 as identical to the third pitch for net sports 26C1.

Thus, according to this embodiment, a first net sport X (for example volleyball) can be played on the net sports pitches 25 arranged on either side of a first section and the extensions 26 thereof, and also on the net sports pitches 25 arranged on either side of the section in parallel with the first section, and the extensions 26 of said parallel section. A second net sport Y (for example badminton) that is different from the first can be played on the net sports pitches 25 arranged on either side of each of the two other parallel sections and the extensions 26 thereof. The first vertical wall 22A' has a first vertical wall height, wherein the second vertical wall 22B has a second vertical wall height, wherein the first vertical wall height is different from the second vertical wall height so as to form a fourth pitch for net sports 25D along perpendicular axes of an angle between the first vertical wall 22A and the second vertical wall upper section 2661. The first vertical wall right side section height of the first vertical wall right side section 26A1 is different from the third vertical wall right side section height of the third vertical wall right side section 26C1 so as to form the additional third pitch for net sports 25C2 as different from the third pitch for net sports 26C1. The first vertical wall 22A is comprised of a rigid bottom wall portion and a flexible top wall portion above the rigid bottom wall portion, and the first vertical wall right side section 26A1 is comprised of a rigid bottom right side section portion and a flexible top right side section portion above the rigid bottom right side section portion. The first vertical wall 22A is comprised of at least two of a group consisting of: a vertical see-through wall, a lattice being comprised of fibers having wires, and a lattice being comprised of cables. The first vertical wall right side section 26A1 is comprised of at least two of a group consisting of: a vertical see-through wall, a lattice being comprised of fibers having wires, and a lattice being comprised of cables. The first vertical wall right side section extension 26A1 has a first vertical wall right side section extension length. The second vertical wall upper section extension 26B1 has a second vertical wall upper section extension length different from the first vertical wall right side section extension length. There can be a ground surface within the first vertical wall, the second vertical wall, the third vertical wall and the fourth vertical wall. The ground surface can be comprised of loose materials.

Figure 2:
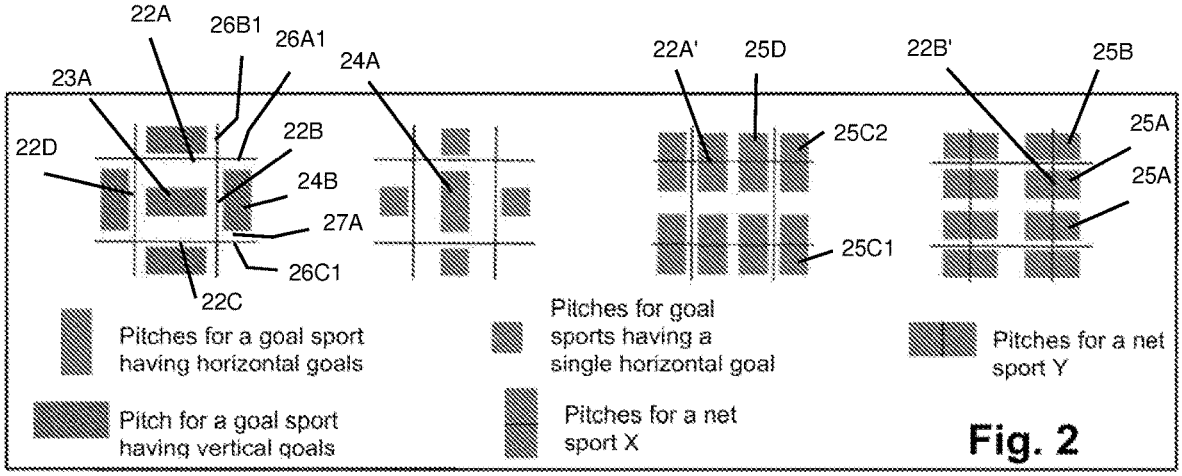
FIG. 2: shows the different possible use configurations of the multisport complex to which the present invention relates, for four different sports that can be practices, when a single one of said sports is practiced at a time in the multisport complex.
Figure 3:
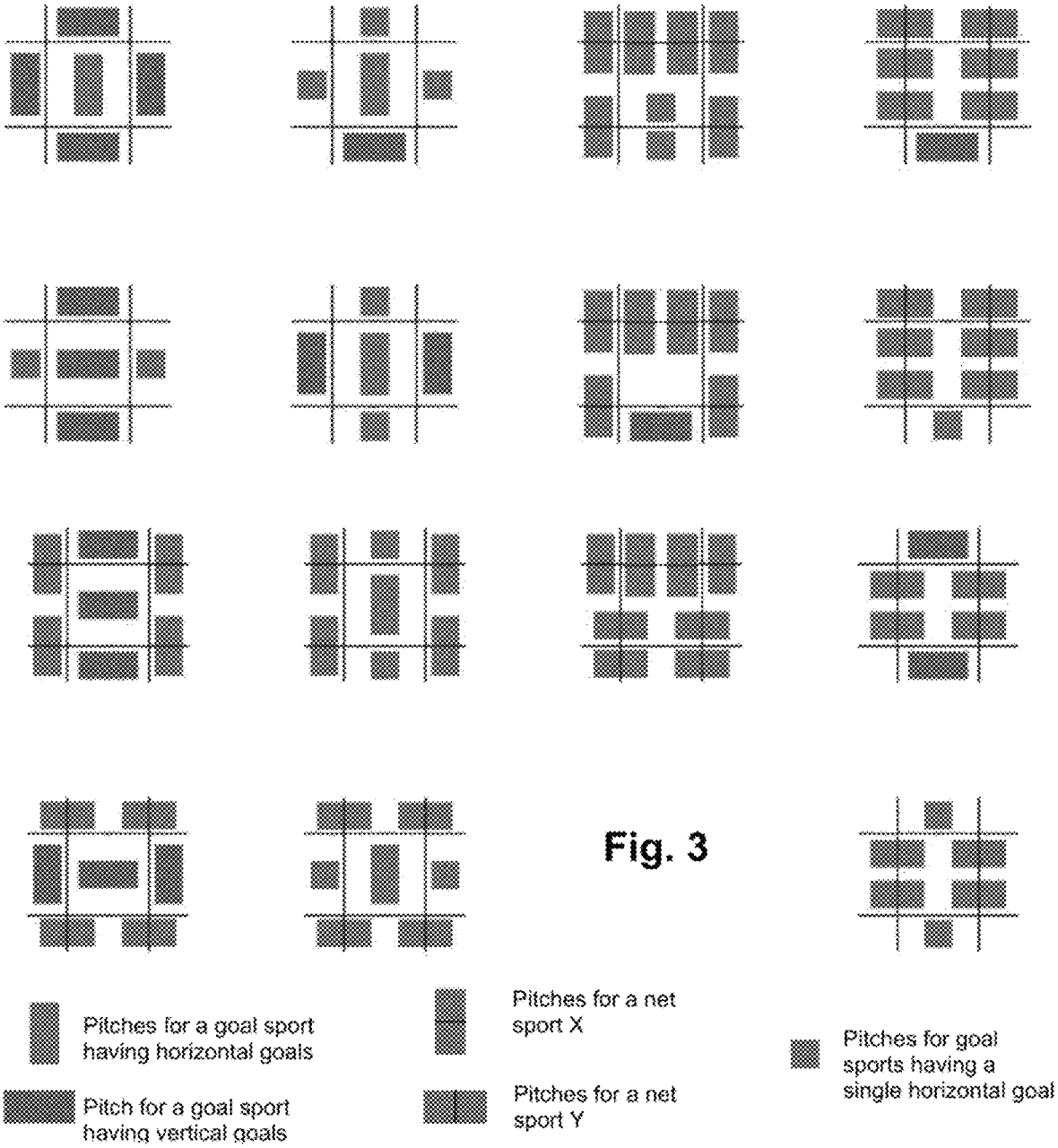
FIG. 3: shows the different possible use configurations of the multisport complex to which the present invention relates, when two different sports are practiced simultaneously in the multisport complex.
Figure 4:
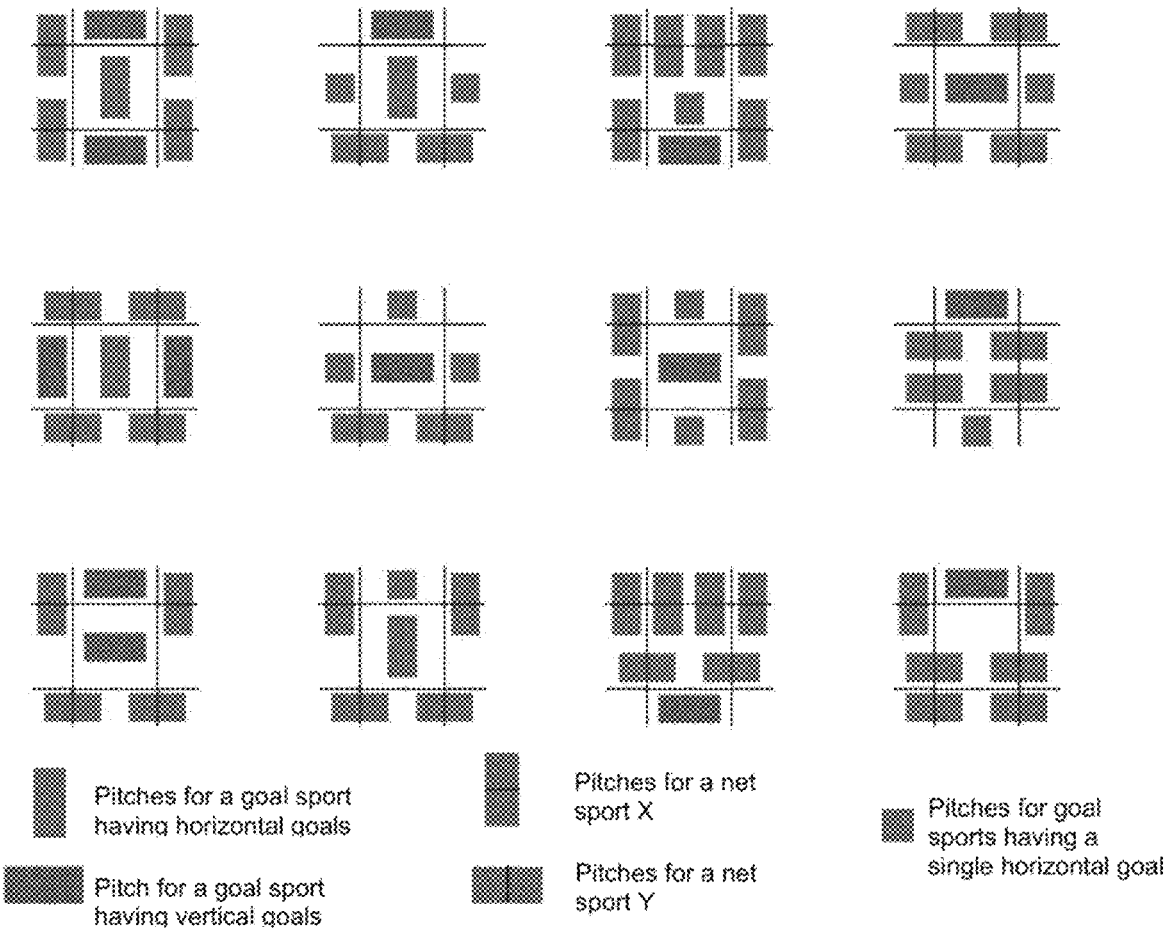
FIG. 4: shows the different possible use configurations of the multisport complex to which the present invention relates, when three different sports are practiced simultaneously in the multisport complex.
Figure 5:
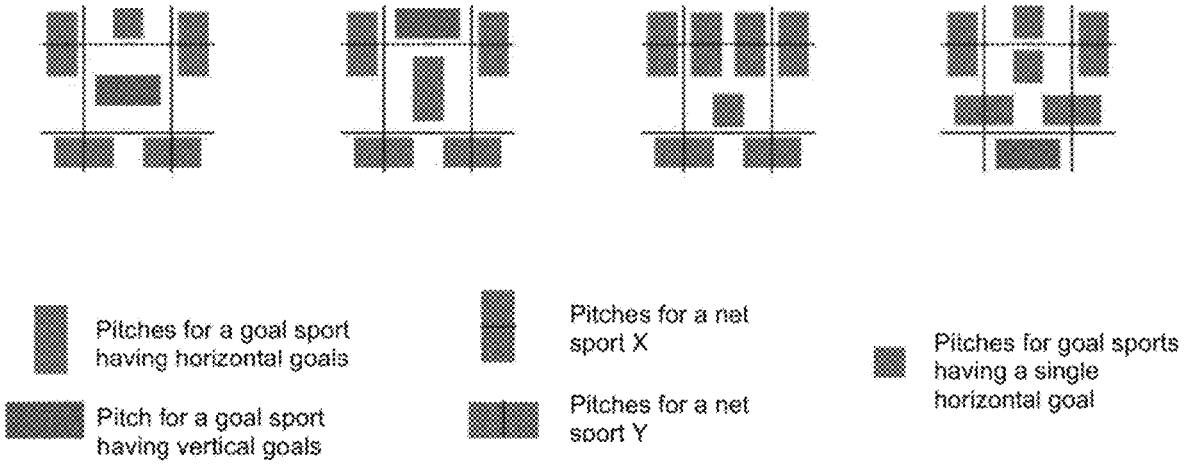
FIG. 5: shows the different possible use configurations of the multisport complex to which the present invention relates, when four different sports are practiced simultaneously in the multisport complex.

Possible configurations of the multisport complex 20 according to the embodiment above, for four different sports that can be practiced (goal sports having horizontal goals, goal sports having vertical goals, net sport X and net sport Y) are shown in FIG. 2 when a single one of said sports is practiced at a time in the multisport complex, and in FIG. 3 when it is necessary to practice two different sports simultaneously (for example at a school, when two classes wish to play two different sports on the multisport complex), in FIG. 4 when it is necessary to practice three different sports simultaneously, and in FIG. 5 when it is necessary to practice four different sports simultaneously.

The goal sports having horizontal goals can be basketball, the goal 15 sport having vertical goals can be football, net sport X can be volleyball, and net sport Y can be badminton.

It will be noted that, for practicing one single sport at a time (FIG. 2), it is possible to simultaneously use five pitches for goal sports having vertical goals, or to simultaneously use five pitches for goal sports having horizontal goals, or to simultaneously use eight pitch for net sport X or Y.

It will furthermore be noted that, in order to practice two different sports simultaneously (FIG. 3), it is possible to use up to seven pitches simultaneously, depending on the sports selected. The same applies for the practice of three different sports simultaneously (FIG. 4).

In order to practice four different sports simultaneously (FIG. 5), it is possible to use up to six pitches simultaneously, depending on the sports selected.

I claim:

1. A multisport complex, comprising:

a first vertical wall;

a second vertical wall connected to said first vertical wall;

a third vertical wall connected to said second vertical wall;

a fourth vertical wall connected to said third vertical wall and said first vertical wall so as to form a first square area for at least one of a group consisting of a first vertical pitch for goal sports for which goals are vertical and start from a ground level, and a first horizontal pitch for goal sports for which goals are horizontal and positioned at a height, wherein said second vertical wall is comprised of a second vertical wall section having a second vertical wall section height so as to form a first pitch for net sports for which net sports projectiles pass over said second vertical wall section;

a first vertical wall right side section extension connected to said first vertical wall and positioned outside said first square area; and a second vertical wall upper section extension connected to said second vertical wall and positioned outside said first square area, wherein said first vertical wall and said second vertical wall upper section are perpendicular so as to form perpendicular axes of an angle between said first vertical wall and said second vertical wall upper section, and wherein said second vertical wall upper section has a second vertical wall upper section height so as to form a second pitch for net sports along said perpendicular axes of said angle between said first vertical wall and said second vertical wall upper section.

2. The multisport complex, according to claim 1, further comprising:

a third vertical wall right side section extension connected to said third vertical wall and positioned outside said first square area, wherein said third vertical wall right side section has a third vertical wall right side section height so as to form a third pitch for net sports along perpendicular axes of an angle between said second vertical wall and said third vertical wall right side section, wherein said first vertical wall right side section extension and said third vertical wall right side section are parallel, and wherein said first vertical wall right side section extension, said second vertical wall, and said third vertical wall right side section form a first additional square area, for a second horizontal pitch for goal sports for which goals are horizontal and positioned at a height.

3. The multisport complex, according to claim 2, wherein said first vertical wall right side section has a first vertical wall right side section height so as to form an additional third pitch for net sports along perpendicular axes of an angle between said second vertical wall and said first vertical wall right side section.

4. The multisport complex, according to claim 3, wherein said first vertical wall right side section height of said first vertical wall right side section is equal to said third vertical wall right side section height of said third vertical wall right side section so as to form said additional third pitch for net sports as identical to said third pitch for net sports.

5. The multisport complex, according to claim 3, wherein said first vertical wall right side section height of said first vertical wall right side section is different from said third vertical wall right side section height of said third vertical wall right side section so as to form said additional third pitch for net sports as different from said third pitch for net sports.

6. The multisport complex, according to claim 2, wherein said first vertical wall has a first vertical wall height, wherein said second vertical wall has a second vertical wall height, wherein said first vertical wall height is different from said second vertical wall height so as to form a fourth pitch for net sports along perpendicular axes of an angle between said first vertical wall and said second vertical wall upper section.

7. The multisport complex, according to claim 1, wherein said first vertical wall is comprised of a rigid bottom wall portion and a flexible top wall portion above said rigid bottom wall portion, and wherein said first vertical wall right side section is comprised of a rigid bottom right side section portion and a flexible top right side section portion above said rigid bottom right side section portion.

8. The multisport complex, according to claim 1, wherein said first vertical wall is comprised of at least two of a group consisting of:

a vertical see-through wall, a lattice being comprised of fibers having wires, and a lattice being comprised of cables; and wherein said first vertical wall right side section is comprised of at least two of a group consisting of:

a vertical see-through wall, a lattice being comprised of fibers having wires, and a lattice being comprised of cables.

9. The multisport complex, according to claim 1, wherein said first vertical wall right side section extension has a first vertical wall right side section extension length, wherein said second vertical wall upper section extension has a second vertical wall upper section extension length different from said first vertical wall right side section extension length.

10. The multisport complex, according to claim 1, further comprising:

a ground surface within said first vertical wall, said second vertical wall, said third vertical wall and said fourth vertical wall, wherein said ground surface is comprised of loose materials.

* * * * *